US011837063B2

(12) United States Patent
Kunzler et al.

(10) Patent No.: US 11,837,063 B2
(45) Date of Patent: Dec. 5, 2023

(54) COMMUNICATION METHOD BETWEEN A SELF-DRIVING VEHICLE AND A LOCKING SYSTEM, AND SELF-DRIVING VEHICLE

(71) Applicant: VOLKSWAGEN AKTIENGESELLSCHAFT, Wolfsburg (DE)

(72) Inventors: Rolf Kunzler, Berlin (DE); Henning Sebastian Vogt, Jembke (DE)

(73) Assignee: Volkswagen Aktiengesellschaft

( * ) Notice: Subject to any disclaimer, the term of this patent is extended or adjusted under 35 U.S.C. 154(b) by 126 days.

(21) Appl. No.: 17/441,742

(22) PCT Filed: Mar. 16, 2020

(86) PCT No.: PCT/EP2020/057148

§ 371 (c)(1),
(2) Date: Sep. 22, 2021

(87) PCT Pub. No.: WO2020/200742

PCT Pub. Date: Oct. 8, 2020

(65) Prior Publication Data

US 2022/0207973 A1 Jun. 30, 2022

(30) Foreign Application Priority Data

Apr. 1, 2019 (DE) ..... 10 2019 204 617.7

(51) Int. Cl.
*G07C 9/00* (2020.01)
*G08B 13/196* (2006.01)

(52) U.S. Cl.
CPC ... *G08B 13/19691* (2013.01); *G07C 9/00182* (2013.01); *G08B 13/19608* (2013.01);
(Continued)

(58) Field of Classification Search
CPC ..... G08B 13/19691; G08B 13/19608; G07C 9/00182
See application file for complete search history.

(56) References Cited

U.S. PATENT DOCUMENTS 9,472,067 B1 * 10/2016 Jentoft ..... G08B 15/02
10,246,054 B2 * 4/2019 Rous ..... B60R 25/01
(Continued)

FOREIGN PATENT DOCUMENTS

AU 2015100226 A4 4/2015
DE 202015001428 U1 7/2015
(Continued)

OTHER PUBLICATIONS

Search Report for International Patent Application No. PCT/EP2020/057148; dated Jun. 25, 2020.

*Primary Examiner* — Daniell L Negron
(74) *Attorney, Agent, or Firm* — BARNES & THORNBURG, LLP

(57) ABSTRACT

A communication method between a self-driving transportation vehicle and a locking system, wherein: a control command is transmitted to the locking system to unlock an entrance; the entrance secured by the locking system is opened so the transportation vehicle is able to pass the entrance or is able to set down or pick up items behind the entrance; the locking system and/or the transportation vehicle includes at least one sensor system for detecting an environment to detect persons or potentially intruding objects in the environment of the entrance; in response to a potentially intruding person or a potentially intruding object being detected, the entrance is not unlocked or an already-unlocked entrance is locked again. Also disclosed is a self-driving transportation vehicle.

9 Claims, 1 Drawing Sheet

(52) U.S. Cl.
CPC ..... *G07C 2009/0092* (2013.01); *G07C 2009/00928* (2013.01)

(56) References Cited

U.S. PATENT DOCUMENTS

| | | | |
|---|---|---|---|
| 2017/0358185 | A1 | 12/2017 | Hu et al. |
| 2018/0141661 | A1 | 5/2018 | Natarajan et al. |
| 2019/0007794 | A1 | 1/2019 | Thakur et al. |
| 2019/0031146 | A1 | 1/2019 | Etonye |

FOREIGN PATENT DOCUMENTS

| | | | |
|---|---|---|---|
| DE | 102015209482 | A1 | 11/2016 |
| DE | 102015117228 | A1 | 4/2017 |
| DE | 102016015444 | A1 | 6/2018 |
| WO | 2018022468 | A1 | 2/2018 |

* cited by examiner

COMMUNICATION METHOD BETWEEN A SELF-DRIVING VEHICLE AND A LOCKING SYSTEM, AND SELF-DRIVING VEHICLE

PRIORITY CLAIM

This patent application is a U.S. National Phase of International Patent Application No. PCT/EP2020/057148, filed 16 Mar. 2020, which claims priority to German Patent Application No. 10 2019 204 617.7, filed 1 Apr. 2019, the disclosures of which are incorporated herein by reference in their entireties.

SUMMARY

Illustrative embodiments relate to a communication method between a self-driving transportation vehicle and a locking system, and a self-driving transportation vehicle.

BRIEF DESCRIPTION OF THE DRAWINGS

Disclosed embodiments are described in detail below with reference to the drawings, in which.

DETAILED DESCRIPTION

Figure 1:
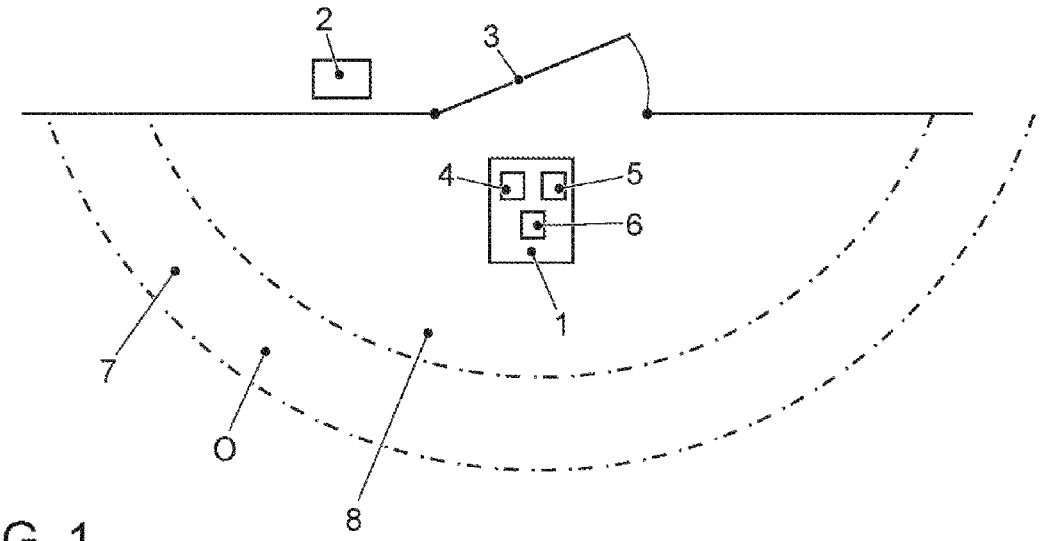
FIG. 1 shows a schematic view of a self-driving transportation vehicle in front of an entrance.

The disclosed embodiments relate to a communication method between a self-driving transportation vehicle and a locking system, and a self-driving transportation vehicle.

A method of this type and a self-driving transportation vehicle of this type are known from WO 2018/022468 A1. The self-driving transportation vehicle serves as a transport vehicle, for example, to collect goods at a meeting point from a larger transport transportation vehicle and deliver them autonomously to a delivery point. The transportation vehicle can have one or more lockable receptacles. It is further disclosed that the transportation vehicle has methods or mechanisms for transmitting control commands directly or indirectly to a locking system, that the entrance is unlocked to open the secured entrance. An entrance of this type can be a house door or garage door. After passing through, the transportation vehicle can accordingly cause the entrance to be closed and the locking system to lock the entrance once more. Self-driving transportation vehicles of this type offer a wide range of new development opportunities in the domain of logistics and adjacent domains.

The technical problem underlying the disclosure is to improve a communication method between a self-driving transportation vehicle and a locking system, and to provide a self-driving transportation vehicle suitable for this purpose.

The solution to the technical problem is provided by a communication method and a self-driving transportation vehicle.

The communication method between a self-driving transportation vehicle and a locking system has the method operation of transmitting a control command to the locking system to unlock an entrance, wherein the entrance secured by the locking system is opened so that the transportation vehicle can pass through the entrance or can set down or pick up items behind the entrance. The control command can be transmitted directly from the transportation vehicle or indirectly via a control center incorporated into the communication. The transportation vehicle authenticates itself and the locking system instigates the unlocking. The entrance can then be opened automatically (e.g., instigated by the locking system), or the transportation vehicle opens the entrance (for example, by a robot arm). The transportation vehicle does not have to pass through the entrance. Instead, the transportation vehicle can also stop in front of the entrance and set down or pick up items by a robot arm. The entrance can, for example, be a house door, a garage door or a transportation vehicle door or a transportation vehicle trunk.

The locking system and/or the transportation vehicle has/have at least one sensor system to monitor a surrounding area to detect persons or potentially intruding objects in the surrounding area of the entrance, wherein, if a potentially intruding person or a potentially intruding object is detected, the entrance is not unlocked or an already unlocked entrance is locked again. The locking also comprises the closing of the entrance if it was already opened. Unauthorized persons are thereby effectively prevented from gaining access or from misusing the automated entrance. The intruding objects can, for example, be other transportation vehicles or drones, but also objects which, for example, can be thrown by a person. The communication between the transportation vehicle and the locking system may be performed wirelessly by a short-range communication method, so that it is ensured that the actual unlocking takes place only if the transportation vehicle is located in front of the entrance. However, further communication methods can be used in advance, for example to announce the transportation vehicle to the locking system. The sensor system can essentially be assigned to the locking system and/or the transportation vehicle.

The sensor system may be assigned exclusively to the transportation vehicle. The benefit is that the transportation vehicle already essentially or completely possesses the necessary sensor system for the self-driving transportation vehicle guidance, so that the additional cost is limited to the additional evaluation. A further benefit is that the monitoring is reproducible, since the transportation vehicle always has only to evaluate its own surrounding area data, and does not have to fuse the data with the sensor data of the respective locking system.

In at least one exemplary embodiment, at least two monitoring areas are defined around the entrance, wherein, in the case of persons or objects in a first monitoring area, a warning signal is generated, wherein the first monitoring area is further away from the entrance than the second monitoring area. The warning signal(s) can be designed very differently and can be designed, for example, as visual and/or audible warning signals to thus indicate to an approaching person that he should remain at a distance from the transportation vehicle or the entrance. The warning signal can further be used to switch the locking system to an alarm state so that it can respond more quickly if necessary. In the case of a plurality of monitoring areas, a stepped warning scenario can be implemented, wherein, with each intrusion into a further monitoring area, the warning is stepped up. This can be implemented in many different ways (e.g., only a visual warning signal can first be emitted, and, in the next warning stage, an audible warning signal can additionally be output).

In a further exemplary embodiment, a movement of the persons or objects is detected, wherein, if the second monitoring area is approached, the warning signal is intensified and/or a further warning signal is generated. This also represents a stepped warning scenario.

In a further exemplary embodiment, in the case of an intruding person or an intruding object, an alarm signal is generated and/or image recordings are made of the person or the object. An alarm signal can thus, for example, be transmitted to a control center and/or to the police. Evidence material, for example, can be secured by the image recordings.

It can further be provided, if an object or a person intrudes into the monitoring area nearest to the entrance, that the transportation vehicle moves into the movement path of the person or object to prevent or hinder an intrusion into the entrance.

With regard to the design of the transportation vehicle, reference is made entirely to the preceding descriptions.

FIG. 1 shows schematically a self-driving transportation vehicle 1 in front of an entrance 3 controlled by a locking system 2, wherein, in the illustration, the entrance 3 is half-opened. The self-driving transportation vehicle 1 has a sensor system 4 to monitor the surrounding area, wherein the sensor system 4 has, for example, at least one camera and/or lidar sensors and/or radar sensors and/or ultrasound sensors. The transportation vehicle 1 can be guided autonomously along a desired trajectory by data from the sensor system 4 and further sensors for position determination. The transportation vehicle 1 further has mechanism 5 for communicating with the locking system 2, and mechanism 6 for generating at least one warning signal.

The sensor system 4 and an associated evaluation unit are designed to define a first monitoring area 7 and a second monitoring area 8, wherein the first monitoring area 7 is further away from the entrance 3 than the second monitoring area 8. The second monitoring area 8 should be so large that a walking or running person does not have time to reach the entrance 3 while it is closing. With an assumed walking speed v, the radius R of the second monitoring area 8 should be defined at least as follows: $R=v \cdot T$, where T is the closing time of the entrance 3.

For further explanation, it is assumed that the transportation vehicle 1 is a transport vehicle wishing to set down or pick up items behind the entrance 3 (for example, a house door). In this case, the transportation vehicle 1 comes, for example, from a larger transport transportation vehicle and drives autonomously to the entrance 3. The transportation vehicle 1 authenticates itself to the locking system 2. A wide variety of methods are possible from which the transportation vehicle 1 has obtained this authentication. This authentication dataset has been generated, for example, during the order placement. However, it can also be created in real time, for example, by performing a dialogue between the transportation vehicle 1 and the locking system 2, wherein a control center is interposed, if necessary, which, e.g., certifies the transportation vehicle 1 as trusted. The transportation vehicle 1 can then transmit a control command to the locking system 2 by the authentication, whereupon the locking system 2 unlocks and, if necessary, opens the entrance 3. However, the entrance 3 can also be opened by the transportation vehicle 1 by a robot arm. The transportation vehicle 1 can then pass through the entrance 3 and set down a transported item or pick up an item (which, for example, is to be returned to a sender) behind the entrance 3. The transportation vehicle 1 does not also have to pass through the entrance 3, but can set down the item from in front of the entrance behind the entrance 3 by a robot arm. Once the procedure is completed, the transportation vehicle 1 communicates once more with the locking system 2 which then closes and locks the entrance 3, wherein the locking is, if necessary, also performed once more by the transportation vehicle 1.

If an object O or a person is detected during a procedure of this type, the risk exists of an unlawful entry through the opened entrance 3, wherein, for the sake of simplicity, only an object O is referred to below, but this also applies accordingly to persons.

If the sensor system 4 now detects an object O in the first monitoring area 7 during the aforementioned method, the mechanism 6 generate a warning signal to warn the object O not to come any closer. The sensor system 4 also evaluates the direction of movement of the object O. If the sensor system 4 then detects that the object O is moving further in the direction of the second monitoring area 8, the warning is intensified, for example, by increasing the volume of an audible signal and/or by increasing the frequency. Voice outputs, such as, for example, "Please stop!", are also conceivable. However, as long as the object O is still located in the first monitoring area 7, the procedure of the unlocking or opening of the entrance 3 is continued.

However, if the sensor system 4 now detects that the object O is intruding into the second monitoring area 8, the procedure is interrupted, and the entrance 3 is closed and locked. The transportation vehicle 1 communicates this by the mechanism 5 of the locking system 2. If the object O then moves away, the method is restarted.

If the object O somehow succeeds in nevertheless unlawfully passing through the entrance 3, the transportation vehicle 1 generates an alarm signal which is transmitted either to a control center or to the police. Image recordings can then be made by the sensor system 4 and are either stored or transmitted online.

Situations are further conceivable where, due to physical conditions, only a second monitoring area 8 is monitorable.

It is further possible for the transportation vehicle 1 to be actively used to prevent or hinder the intrusion of an object O, whereby the transportation vehicle 1 confronts the object O or intrudes into its movement path.

Figure 2:
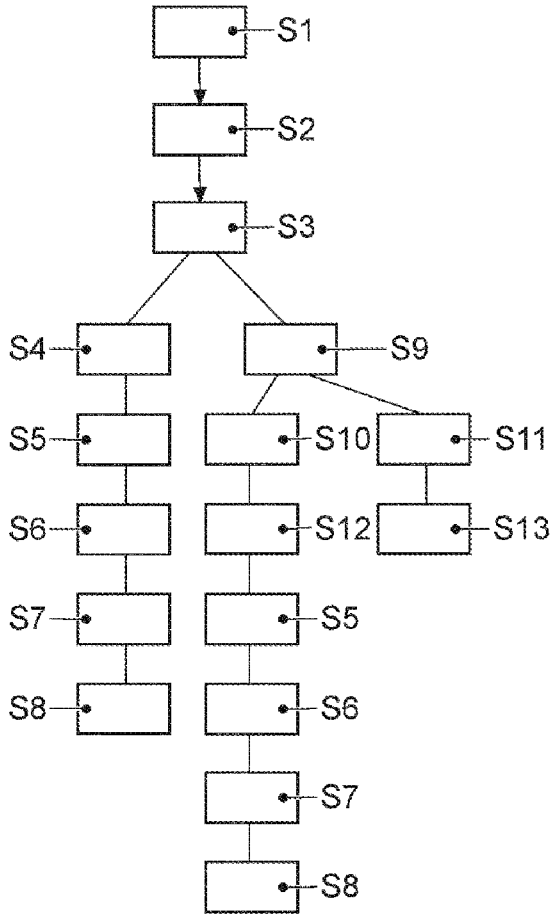
FIG. 2 shows a schematic flow diagram of a communication method between a transportation vehicle and a locking system.

FIG. 2 shows schematically a flow diagram of the method in simplified form. In a first operation at S1, the transportation vehicle 1 authenticates itself to the locking system 2. In a second operation at S2, which can also be carried out in parallel with operation at S1, the sensor system 4 monitors the surrounding area for objects O. In a third operation at S3, it is established whether an object O has or has not been detected. If no object is identified in operation at S4, the entrance 3 is unlocked and opened in operation at S5. In an operation at S6, an item is then sent down or picked up and, in an operation at S7, the entrance 3 is closed and locked once more. Operation at S8 then ends the method.

Conversely, if it is established in operation at S9 that an object O is present, a check is carried out to determine whether the object is located in the first monitoring area 7 (operation at S10) or in the second monitoring area 8 (operation at S11). If the object O is detected in the first monitoring area 7, a warning signal is output in a operation at S12. The direction of movement and/or speed of movement can additionally be detected and the warning signal type can be adapted. As long as the object O remains in the first monitoring area 7, the method operations at S5 to S8 further proceed. Conversely, if it is established in operation at S11 that the object O is located in the second monitoring area 8, the method is interrupted in operation at S13 and the entrance 3 is closed or locked.

The invention claimed is:

1. A method for communication between a self-driving transportation vehicle and a locking system for securing an enclosure entrance, the method comprising:

monitoring, by the transportation vehicle using at least one sensor system that is part of the transportation vehicle, an area surrounding the enclosure entrance to detect persons or potentially intruding objects in the surrounding area of the entrance; and selectively transmitting control command instructions to the locking system to unlock the enclosure entrance that is secured by the locking system, wherein the entrance is thereby opened so that the transportation vehicle can enter the entrance or set down or pick up one or more items within the enclosure through the entrance, wherein the selective transmission of control command instructions is based on detection of a potentially intruding person or a potentially intruding object by the at least one sensor system, and wherein the selective transmission of control command instructions to the locking system also includes transmission of a control command to the locking system to lock an already unlocked entrance in response to the detection of a potentially intruding person or potentially intruding object when the detection occurs while the entrance is unlocked.

2. The communication method of claim 1, wherein at least first and second monitoring areas are defined around the entrance, wherein the first monitoring area is farther away from the entrance than the second monitoring area, and the method comprises the at least one sensor system generating a warning signal in response to detection of persons or objects in the first monitoring area.

3. The communication method of claim 2, further comprising intensifying the warning signal and/or generating a further warning signal in response to detection of a movement of the person or objects in the first monitoring area that approaches the second monitoring area.

4. The communication method of claim 1, further comprising generating an alarm signal and/or recording one or more images of a person or object detected in the area surrounding the entrance.

5. A self-driving transportation vehicle comprising:

a sensor system;

a control unit for the self-driving vehicle; and a communication mechanism configured to selectively communicate with a locking system of an entrance that secures the entrance selectively transmitting control command instructions to the locking system to unlock the enclosure entrance that is secured by the locking system, wherein the entrance is thereby opened so that the transportation vehicle can enter the entrance or set down or pick up one or more items within the enclosure through the entrance, wherein the sensor system is configured to monitor an area surrounding the self-driving vehicle thereby monitoring the entrance to detect persons or potentially intruding objects in the area surrounding the entrance, wherein, based on detection of a potentially intruding person or a potentially intruding object by the sensor system in the area surrounding the entrance, the communication mechanism selectively transmits control command instructions to the locking system so the entrance is selectively not unlocked in response to issuance of a control command which would otherwise unlock the entrance, and wherein the selective transmission of control command instructions to the locking system also includes transmission of a control command to the locking system to lock an already unlocked entrance in response to the detection of a potentially intruding person or potentially intruding object when the detection occurs while the entrance is unlocked.

6. The self-driving transportation vehicle of claim 5, further comprising a mechanism for generating a warning signal, wherein at a first and a second monitoring area are defined in an area surrounding the entrance, wherein the first monitoring area is farther away from the entrance than the second monitoring area, and wherein, in response to detection of persons or objects in the first monitoring area, a warning signal is generated.

7. The self-driving transportation vehicle of claim 6, wherein the sensor system is configured such that, in response to detection of a movement of the person or objects in the first monitoring area approaching the second monitoring area, the warning signal is intensified and/or a further warning signal is generated.

8. The self-driving transportation vehicle of claim 5, wherein the sensor system is configured such that, an alarm signal is generated and/or image recordings are made of the person or the object in response to detection of the intruding person or intruding object.

9. The self-driving transportation vehicle of claim 5, wherein the control unit of the transportation vehicle is configured to control the transportation vehicle to move into a movement path of an intruding person or an intruding object.

* * * * *